US005669179A

United States Patent [19]

Hanlon

[11] Patent Number: 5,669,179

[45] Date of Patent: Sep. 23, 1997

[54] LOUVERED APPARATUS FOR THE REGULATION OF SOLAR LIGHT AND HEAT RADIATION THROUGH WINDOWS AND THE LIKE

[76] Inventor: William S. Hanlon, U.S. Post Office-Battle Grd., WA-608 W. Main St., Battle Grd., Wash. 98604-6902

[21] Appl. No.: 621,446

[22] Filed: Mar. 25, 1996

[51] Int. Cl.[6] ..... E06B 7/08

[52] U.S. Cl. ..... 49/64; 49/74.1; 49/82.1; 49/87.1

[58] Field of Search ..... 49/74.1, 82.1, 49/87.1, 90.1, 64

[56] References Cited

U.S. PATENT DOCUMENTS

| | | | |
|---|---|---|---|
| 1,486,569 | 3/1924 | Diniaco | 49/87.1 |
| 2,365,319 | 12/1944 | Young | 49/87.1 |
| 2,785,446 | 3/1957 | Silverman | 49/82.1 |
| 3,460,289 | 8/1969 | Toth | 49/82.1 |
| 5,306,210 | 4/1994 | Smit | 49/74.1 |

FOREIGN PATENT DOCUMENTS

| | | | |
|---|---|---|---|
| 354121542 | 9/1979 | Japan | 49/74.1 |

*Primary Examiner*—Kenneth J. Dorner
*Assistant Examiner*—Curtis Cohen

[57] ABSTRACT

An improved louvered apparatus for the regulation of solar light and heat radiation through windows and the like, is disclosed. The unique configuration of the present invention is innovative, simple, and a considerable improvement over the conventional louvered apparatuses. Some of the various features of the present invention, which are described, herein, include precise very low frictional operation, apparatus is maintenance free, a compact design, uncomplicated fast two-bracket installation, available in the standard manual, or optional remote electronic actuation, and apparatus has been designed to be manufactured inexpensively.

6 Claims, 4 Drawing Sheets

(LOUVERS, NO.2, SHOWN IN CLOSED POSITION)

(MANUAL OPERATION)

(ELECTRONIC OPERATION)

LOUVERED APPARATUS FOR THE REGULATION OF SOLAR LIGHT AND HEAT RADIATION THROUGH WINDOWS AND THE LIKE

BACKGROUND OF THE INVENTION

1. Field of the Invention

This invention generally relates to a concept of providing a means in which the intensity of both heat and light radiation, entering a window, or the likes, can, thereby, be regulated to a more desired, or required, level, with the installation and operation, of the present invention. The present invention is comprised of a center mullion (housing), preferably "U" in shape, and having a plurality of preferably, rectangular in shape, louver plates operably mounted to each of the lower sides of said center mullion member, and adjacent to each other. Moreover, each of the plurality of louver plates are fastened to a preferably square tubing axle member. Further, each of the plurality of square tubing axle members are thereby operably mounted to said center mullion through a plurality of parallel apertures therethrough both lower sides of said center mullion. Further, each of the plurality of square tubing axle members are thereby pivotably connected, by means of a bracket arrangement, to a pivot arm member. Upon said pivot arm member being moved in a forwardly direction, the plurality of rectangular axle mounted, louver plates will thereby rotate in a direction of a closing mode, and do so within a ninety degree circumferential quadrant. Transitionally, and upon movement of said pivot arm member in a backwardly direction, the plurality of the axle mounted rectangular louver plates will, thereupon, rotate in a direction of an opening mode, and do so within the aforementioned, ninety degree circumferential quadrant. The required linear movement of said pivot arm member, and resulting positioning of the plurality of axle mounted louver plates, facilitating the regulation of light and heat penetration through the window, is, thereby provided by either a manual, or an automatic electronic means, having a remote controller.

2. Description of the Relevant Art

Along with the growth of the related technology, solar energy has become a more viable energy source consideration. Many apparatuses, have been, and are being, invented to utilize this "renewable" energy source. In applications for temperature and light control, within a building structure, most, if not all, of these devices, control/regulate, the incidence of the suns heat and light, through the utilization of some form of a "plurality of louvers." The actual efficiency, of any of these devices, is thereby directly dependent upon the design, and operation, of the "louver assembly." Accordingly, the design and materials, used in the louver arrangement, must be better than the conventional, "plurality of louvers." Due to the sun's constant impingement on the louver assembly, and its components, proper maintenance of the device is essential to the units operation. Accordingly, the design of the louver assembly, should then facilitate as much of a, "maintenance free" operation, as practical. The design should, as well, encompass, simplicity in operation, minimal friction in all moving components, high degree of light tightness, compactness, ease of installation, aesthetic value, and be cost balanced. An example of the apparatuses which have been devised for the preceding solar energy application, is the U.S. Pat. No. 3,884,414 filed by Stephen C. Baer, on Apr. 8, 1974, and issued on May 20, 1975, wherein a solar energized heating device is said to maximize the transfer of solar energy to the interior of a structure while minimizing heat loss therefrom. In this apparatus, the conventional plurality of louver panels are said to be activated, opened and closed, by the transferring of a volatile fluid, such as freon, from the exterior canister to the interior canister, or in reverse order, based on the sun's influenced, temperature differential of the fluid in the two canisters, and resulting weight distribution thereof. Here, however, little detail is given, both written and diagrammatically, with regards to the actual construction of the apparatus. The method, as stated, to activate, open and close, the plurality of conventional louver plates, obviously, will, very much, require a very low frictional movement at both the louver plate and the rod pivot points. The capacity, and fluid charge, of the two canisters, will be critical to the required movement of the conventional plurality of louver plates. Other features have been embodied in various apparatuses, of the preceding type, as disclosed, e.g., in U.S. Pat. No. 4,279,240, filed by Bobby L. Artusy on Dec. 4, 1979, and issued on Jul. 21, 1981; U.S. Pat. No. 4,349,011, filed by Clarence E. Hartsog on May 22, 1981, and issued on Sep. 14, 1982; U.S. Pat. No. 4,505,255 filed by Stephen C. Baer on Nov. 14, 1983, and issued on Mar. 19, 1985. Here, however, the conventional pluarity of louvers, or a form thereof, which each of the preceding patents employ as a means for regulating the solar energy, is, once again, presented in vague terms. When considering the fact that "any" form of a louver arrangement, will require a specific energy force to cause the required degree of movement, of the quantity of louvers, and linkage, pivot points, within the embodiment, then one must also consider the size canisters, and fluid charge, required to perform the intended function. Another embodiment for an apparatus of this type, has been illustrated in the above mentioned U.S. Pat. No. 4,505,255, which is said to employ a sun tracking device. This feature is said to maximize the sun's radiation intake of the apparatus during the winter months, by tracking the sun's movement throughout the day. Here, however, consideration should be given to the design and type of operation of the device. Due to the sun's distance from the earth, during the winter months, very little thermal value, on average, is available from the sun's radiation. Without the use of a large, elaborate, collection system, the heat yield from the sun's radiation, during the winter months, would, for any practical purpose, prove to be quite limited in the heating requirements of a structure. Based on the preceding, further consideration might be given to the solar energized operation on the tracking system. It would, indeed, appear that little consideration has been given to the costs involved in the manufacturing of any of the preceding patents. Obviously, the cost of any of the preceding apparatuses, must be justified by the function performed by the unit. Another embodiment utilizing a plurality of louvers for regulating solar radiation, both heat and light, is found in U.S. Pat. No. 4,313,650, filed by Jack D. Ward; Douglas G. Ward, on Jun. 27, 1980, and issued on Feb. 2, 1982. In the Jack D. Ward; Douglas G. Ward device, the apparatus is said to control light and heat transference for greenhouses. To perform this function, U.S. Pat. No. 4,313,650 is comprised with a plurality of light weight, rigid, insulative slats/louvers operable to be selectively opened or closed, in venetian blind style, to selectively lighten or darken any or all portions of a greenhouse. The apparatus is said to produce low thermal conductivity and low emissivity of thermal radiation to retain heat within the greenhouse. The slats/louvers are said to be arranged in pitched roof manner and are operable to drain condensed moisture when closed. Another embodiment of a similar apparatus to the preceding, is the U.S. Pat.

No. 4,128,307 filed by Hans Badertscher; Walter Schindler on Jun. 20, 1977, and issued on Dec. 5, 1978. This embodiment is said to control the incidence of heat and light radiation on a growing area of a greenhouse, or the like, comprises slats/louvers of a non-self-supporting material, which are tensioned to hold them in shape. The slats/louvers are arranged in parallel, side-by-side relationship, to cover substantially, the whole growing area, and can be tilted like venetian blinds. Another patent for regulating solar heat and light, for greenhouse roof structure use, is the U.S. Pat. No. 5,306,210, filed by Dirk V. Z. Smit on Aug. 12, 1992, and issued on Apr. 26, 1994. The above patent relates to a louver type of a roof structure, for a greenhouse application, and, primarily, consists of the many various component parts as is used in the construction of such a roof structure, and to a method for their construction. The patent, however, makes no mention of the water tight glazing, which obviously, must be in place in the stated roof structure to facilitate heat retention within the building structure, and to allow the entrance of the solar heat and light radiation, during adverse weather and winter months, when the plurality of louvers are in their open mode. The roof louver arrangement will be in the open position during most daylight hours of any given day. What is disclosed in each of the preceding-cited patents, are inventions which appear to lack in the required considerations as to the specifics of their component parts. As shown, few, if any, of the apparatuses indicate any form of simplicity in their design. All of the preceding patents will require very precise movements of their many component parts to achieve their intended function. Precise alignment and proper lubrication of the pivoting members in the embodiments, as shown, will be paramount to an acceptable operation of same. As is the case, in most, if, not all, of the preceding patented apparatuses, a conventional plurality of louvers has been utilized in the embodiment. The louver plates are pivoted from their ends within a square or rectangular housing. Each of the louver plate ends have a round spindle/axle which, in turn, pivots within a round aperture located in the adjacent housing wall. The louver axle, and aperture in the housing, are normally a loose fit so as to facilitate a non-precise and non-lubricated pivoting movement. Accordingly, the pivot movement of the louver plates, within the peripheral housing, are not precise enough to provide for the required simultaneous pivoting of the louver plates to establish the light seal required, for the closed mode. To hinder the pivoting action further, is the circumferential friction, in the non-lubricated pivot joint of the louver plate axle, and the aperture in the adjacent housing wall. Obviously, this inadequately designed pivot joint will require much more energy force to properly adjust the louvers, than would a joint which provides for a more precise and less frictional movement. Here, again, the costs for manufacturing any of the preceding apparatuses may prove to be quite unacceptable with relation to their intended function.

In the preferred embodiment of the present invention, the applicant has employed, as criterion for the design of an improved louvered apparatus, used for the regulation of solar heat and light radiation through any form of window, the following improved features. First, thorough consideration has been given to the required functioning of each component part in the embodiment. The design is simple, and provides all the requirements for the intended operational performance. Second, little, if any, maintenance will be required for the life of the apparatus. Third, the improved innovative design, and compactness, thereof, enhances the aesthetic value, well beyond that of the conventional plurality of louvers. Fourth, the present invention has been designed to facilitate an easy installation in both new construction, and in retro-fit applications. Finally the present invention has been designed to be manufactured inexpensively. To be assured of the above, several proto-types of the present invention have been manufactured, installed, and thoroughly tested, prior to the applicants patent application to the U.S. Patent and Trademark Office. Each of the prototypes of the present invention, has performed/operated, extremely well in all areas as previously stated in the design criterion.

It is, therefore, an object of the present invention, to provide an improved louver assembly for the regulation of solar energy radiation entering any type of building structure. The improved design of the present invention produces a very low friction, and precise movement, of all moving components in the entire apparatus, reducing required energy force, and promoting a better light seal, and adjustment operation.

It is another object of the present invention design, to facilitate a maintenance-free operation for the entire life of the apparatus. The cumbersome requirement of lubrication or component part adjustment, for the many parts of the embodiment, has been eliminated by the use of nylon bearings and a precise assembling of all component parts.

It is, yet, another object of the present invention, to produce an improved and less complicated installation, in both new construction and in retro-fit applications. Due to the improved compact configuration of the present invention, the entire louver apparatus can be installed into a roof, or wall, glazed opening, by the use of two (2) small metal brackets.

It is, yet, a further object of the present invention to provide for both a manual, or remote electronic means, of adjusting the louvers to the required degree of opening or closing. Due to the extremely low friction and precise movement of component parts of this preferred embodiment, very low current is required for this electronic operation feature.

It is, yet, a further object of the present invention, to provide a new and improved concept for a plurality of louvers which can be manufactured and retailed, at a much lesser cost than the previously-cited apparatuses as shown.

SUMMARY OF THE INVENTION

The aforementioned, and other objects of the present invention, and preferred embodiments, thereof, are accomplished by providing a new and improved concept for a plurality of louvers used for the purpose of regulating solar energy radiation through a windowed/glazed opening in a building structure. The new and unique design of the present invention provides for improved pivoting movement of all louver plates within the embodiment, improved compactness in the apparatuses configuration, improved aesthetic value, an improved method of installation, and the present invention has been designed to be manufactured and retailed, inexpensively.

These and other features of the present invention, and its preferred embodiments, will, for purposes of more clarity, be defined in greater detail in the following descriptions, and associated drawings.

DESCRIPTION OF THE PREFERRED EMBODIMENT

Figure 1:
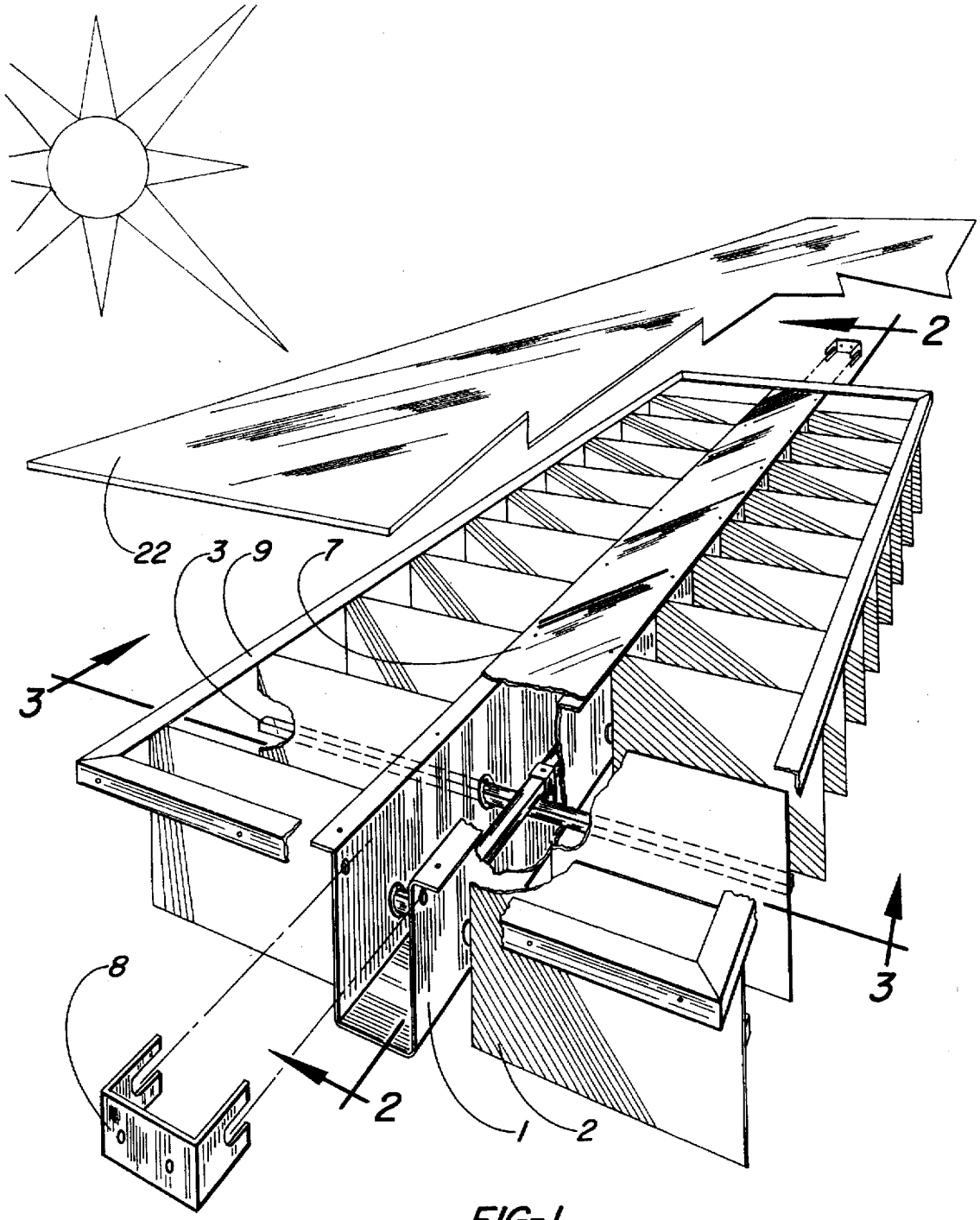
FIG. 1 is a two-point perspective drawing of the improved louvered apparatus of the present invention.

FIG. 1 is a two-point perspective view of the improved louvered apparatus which illustrates the total embodiment of the present invention. As shown, the preferably "U" shaped, center housing, designated by the reference Numeral 1, houses all of the louver plate pivoting mechanism. Center housing 1 is complete with a plurality of round apertures on both lower sides of the aluminum formed component. Each of the round apertures is fitted with a "snap-in" type of nylon bearing, as designated by the reference Numeral 10. Therethroughout, and rotatably mounted, are the, preferably square, aluminum tubing axle's, as designated by the reference Numeral 3. Said axle's 3 are captivated within the interior of said center housing 1 by nylon washers, designated by the reference Numeral 11, and aluminum cotter pin's, designated by the reference Numeral 12. Refer to FIG. 3 for greater definition of the preceding. The preferably flat, rectangular, aluminum louver plates, as designated by the reference Numeral 2, are thereto fastened, on both sides of the center housing 1, to the protruding extensions of said axle's 3, with aluminum blind rivets, as designated by the reference Numeral 14. Refer to FIG. 3 for greater definition of the preceding. The preferred aluminum mounting brackets, as shown, and as designated by the reference Numeral 8, are fastened to the interior upper and lower ends of the glazed window opening, within the building structure, and done so, with the required type and size of fasteners as designated by the reference Numeral 20. Refer to FIG. 3 for greater definition of the preceding preferred installation method. As shown in FIGS. 1, 2, 3, and 4, the upper peripheral light/heat seal frame, as designated by the reference Numeral 9, is preferably, an aluminum angle frame, which is positioned and fastened, slightly below the window opening's glazed surface, as designated by the reference Numeral 22. Said upper frame 9, shields the entrance of solar energy radiation from "directly" entering the building structure through the outer peripheral space, between the window opening and outer edges of the closed plurality of louver plates. Refer to FIG. 3 for greater definition of the preceding. Said upper frame 9 is fastened to the inner window opening with appropriate fastener as designated by the reference Numeral 15. As shown, center housing 1 has been designed with an upper formed flange, for two purposes. First, the formed flange prevents solar radiation from directly entering between the "closed" louver plates 2, and the center housing 1. Second, the flange provides a mounting surface for the preferred, light gauge, highly polished, aluminum cover plate, as designated by the reference Numeral 7. Said cover plate 7 is fastened to the upper flange of the center housing 1 for the purpose of protecting all nylon bearing components, within the center housing 1, from direct sun impingement, and excessive heat build within the embodiment. Cover plate 7 is fastened to the center housing 1 with fastener Numeral 14, as shown in FIG. 3. The formed flange, on the upper portion of center housing 1, as well, adds considerable strength to the formed aluminum component part of the apparatus.

Figure 2:
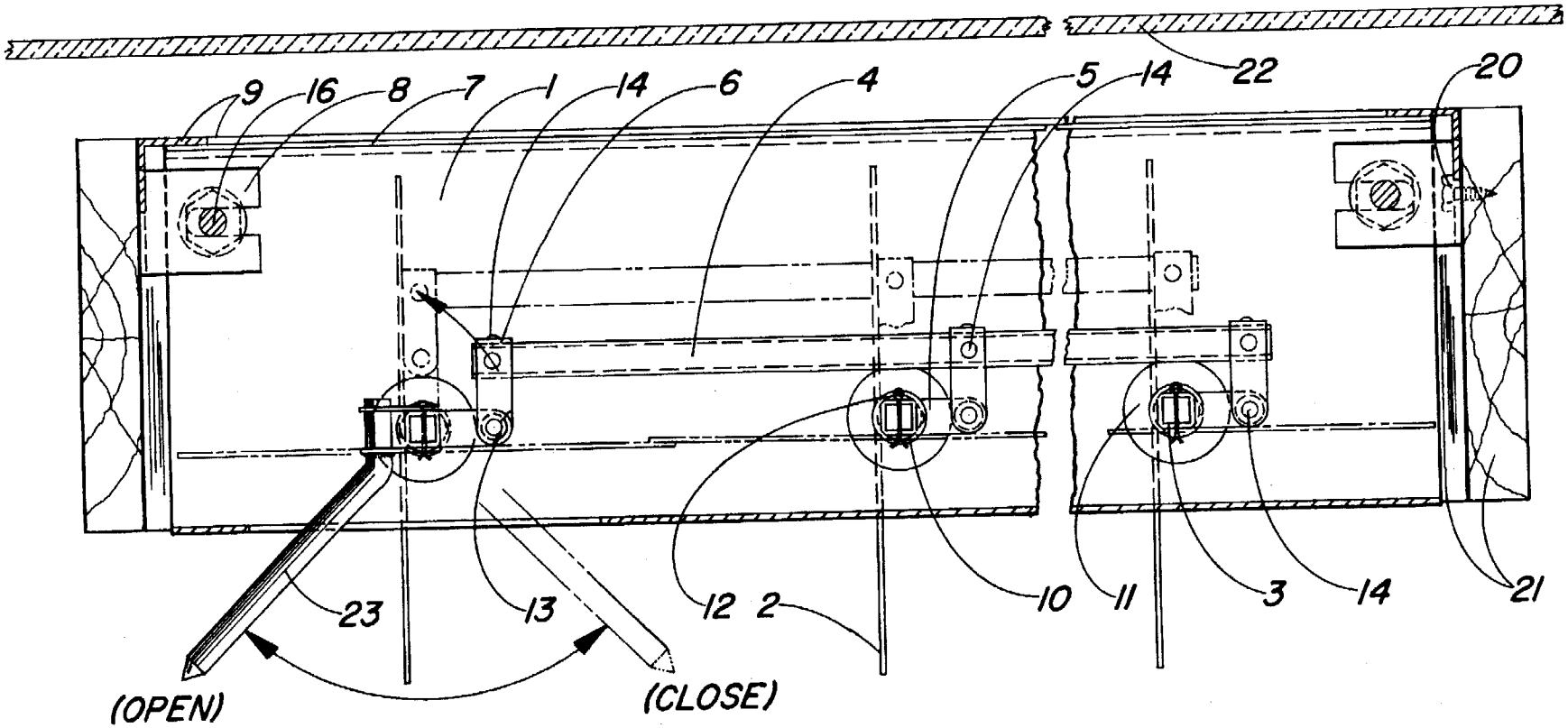
FIG. 2 is a sectional view depicting the inner component parts, and their function within the present invention. This sectional view also depicts, in general, the preferred method of installation of the improved louvered apparatus. In this view, the manual operation is shown.
Figure 3:
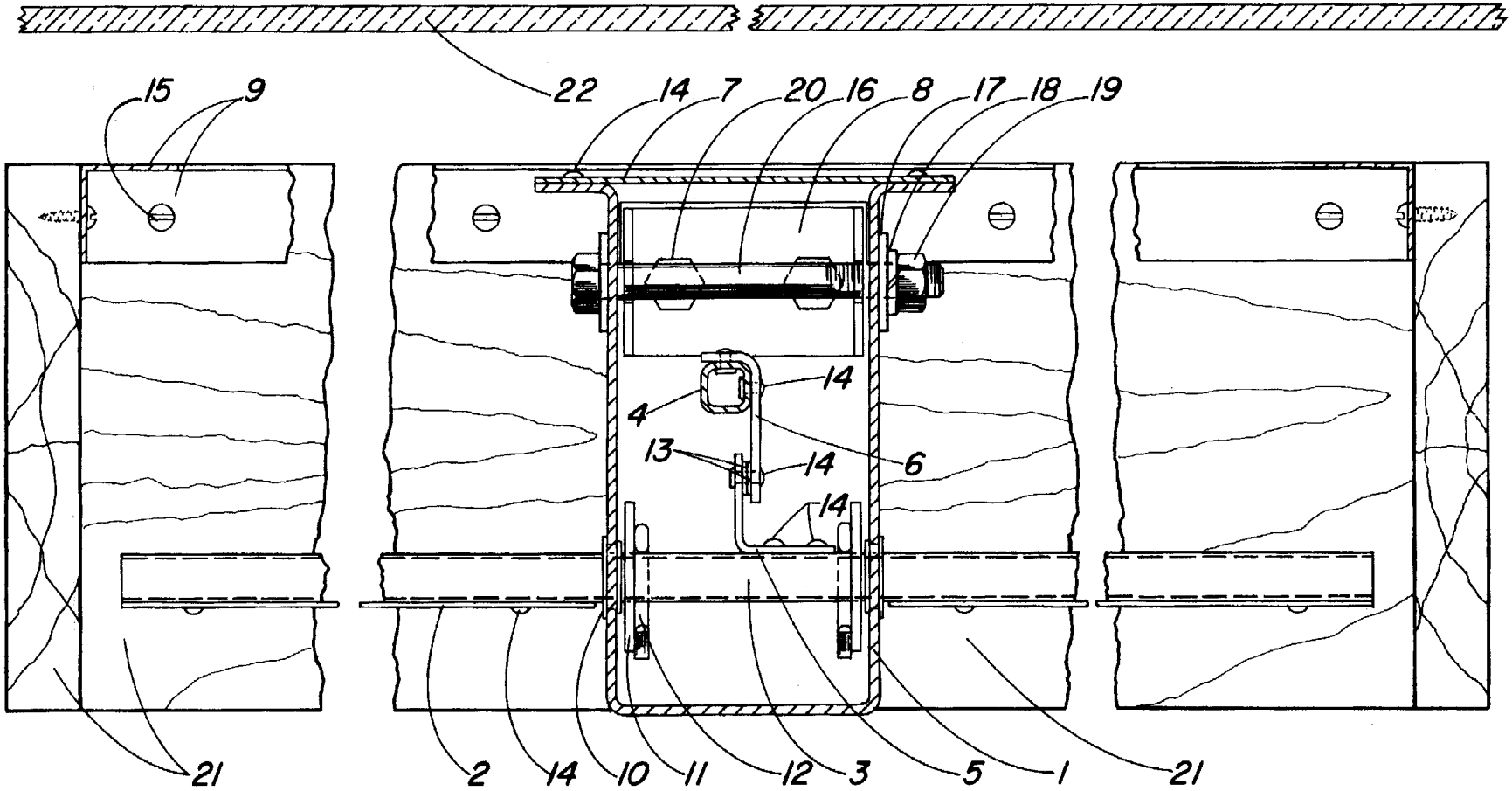
FIG. 3 is a sectional view depicting the uniqueness of the improved design of the improved louvered apparatus. In this view, the cantilevered louvers can be seen mounted on the aluminum square tubing axle, which is, thereby, rotatably mounted, with nylon bearings, through apertures in the compact center mullion, of the preferred "U" shaped, housing. In this view, one of the two end mounting brackets, and mounting bolt, is shown in the preferred installation method. Depicted in this view, as well, is the upper peripheral light seal frame, shown fastened to window opening, slightly below the glazing.

As illustrated in FIGS. 2 and 3, each of the plurality of the preferred aluminum square tubing axle's 3, are fitted with an axle pivot bracket, as designated by the reference Numeral 5. The said axle pivot bracket 5, is fastened to axle 3, by use of two aluminum blind rivets 14. Rotatably coupled with said axle pivot bracket 5, and with two nylon washers, as designated by the reference Numeral 13, and said aluminum rivet 14, is the louver pivot arm bracket, as designated by the reference Numeral 6. Therethroughout, the plurality of said pivot arm bracket 6, will be fastened to the pivot arm, as designated by the reference Numeral 4, by the use of the aluminum blind rivet 14.

Figure 4:
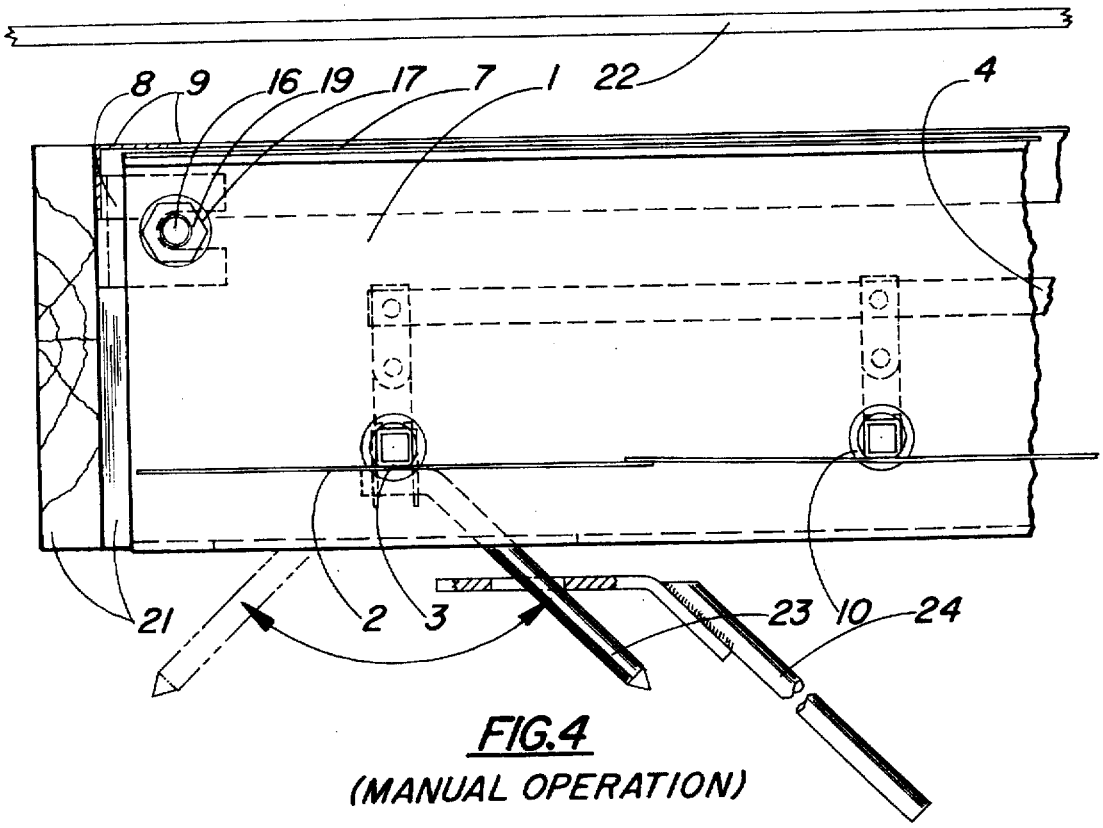
FIG. 4 is a sectional view of the present invention, which depicts the "manual" operation of the apparatus. As shown, the louver adjusting hand tool is fitted with an end piece which captivates the louver adjustment lever. Upon the forward movement of the louver adjustment lever, with a 90 degree arc, all louver plates will then pivot to a total open mode. In this open mode, the plurality of louvers, in the apparatus, will then be positioned at 90 degrees perpendicular to the glazed surface of the opening. The reverse movement of the louver adjustment lever, will then, completely close all louver plates in the apparatus. Any degree of a desired opening of the plurality of louver plates can be easily achieved by the movement of the louver plate adjustment lever, within the 90 degree arc.
Figure 5:
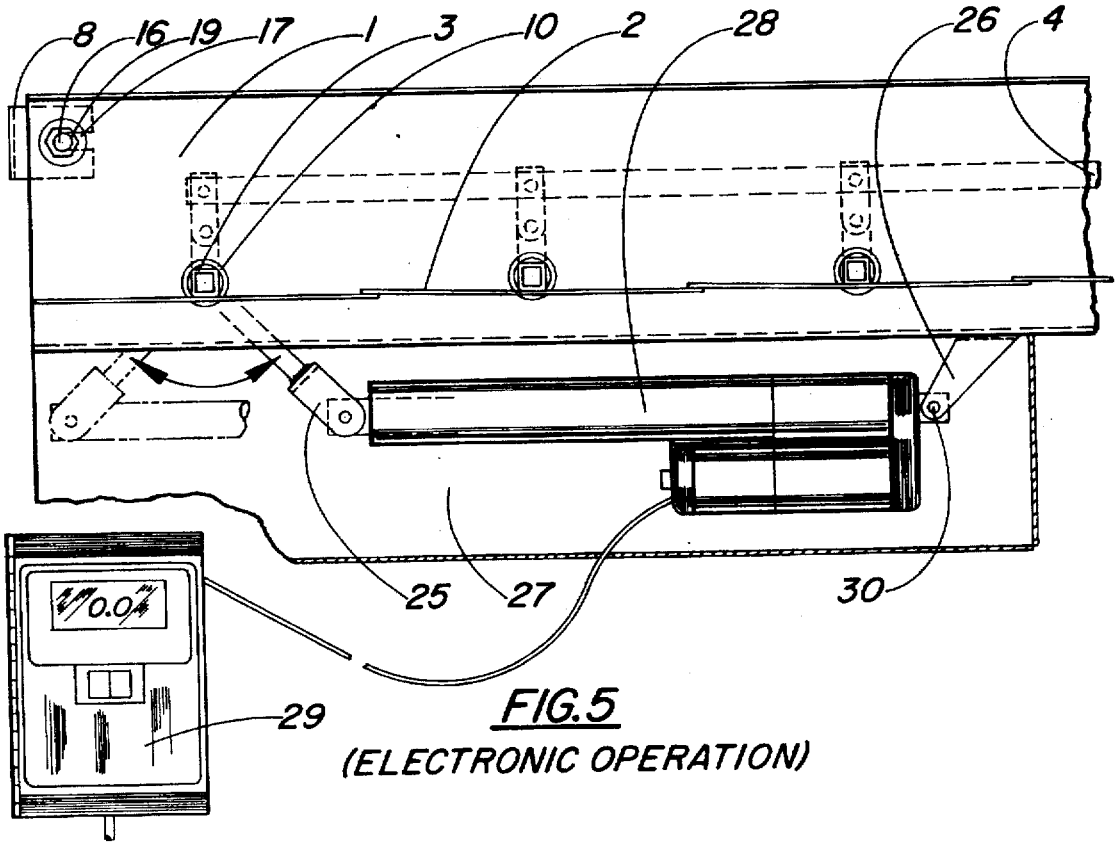
FIG. 5 is a sectional view of the present invention, which is very similar to FIG. 4, but, slightly different due to the requirements of the "optional" electronic operation of the present invention. As depicted in this view, the basic component parts, and their functions, are the same as shown in the manually operated embodiment; but, with the exceptions of the "clevis" type louver adjustment lever, and addition of the electronic linear actuator system, its enclosure, and the remote controller. In applications where the improved louvered apparatus is located in a location too cumbersome for the manual operation, the optional electronically actuated version of the present invention is available. This automatic, remote controlled, improved louvered apparatus requires a standard electrical input of 120 V.A.C. for its operation. The remote controller will control the actuator's movements, of the plurality of louver plates, from the totally open mode, to the totally closed mode, and including, all desired settings within the two modes. The remote controller will display, in an LCD digital readout, the plurality of louvers percentage of opening.

As shown in FIGS. 2, 4, and 5, the adjusting lever, as designated by the reference Numeral 23, or the optional, "electronically actuated", adjusting lever as designated by the reference Numeral 25, is fastened to the axle 3, nearest to the adjustment slot end of the center housing 1. The said adjusting levers, 23 or 25, are fastened to the axle 3, by use of said aluminum blind rivet 14.

As is illustrated in FIGS. 4 and 5, the present invention's preferred embodiment is available with either a manual, or an electronically actuated operation. As shown in FIG. 4, the "manual" version of the preferred embodiment, a louver plate adjusting hand tool, as designated by the reference Numeral 24, is fitted with an end plate, having a round aperture, which when positioned, captivates the adjusting lever 23, of the preferred embodiment, to facilitate the adjustment of the plurality of louver plates. Upon the linear movement of the manual hand tool 24, within the 90 degree circumferential quadrant as shown, the entire plurality of louver plates can be simultaneously adjusted to any desired opening or closing value.

As shown in FIG. 5, is the "optional" electronically actuated version of the preferred embodiment of the present invention. In this version, all component parts are the same as the manually operated apparatus, with the exception of a "clevis" type of adjusting lever 25, and the addition of the electronic actuator 28, its enclosure 27, and the remote controller 29. The electronic actuated operation requires a standard electrical input of 120 VAC. The remote controller 29, will completely adjust/control the entire plurality of louver plates 2, within the apparatus, from a fully opened position, to the fully closed position, and all desired settings there within. The remote controller 29, will display, in an LCD digital readout, the "percentage of opening" of the plurality of louver plates within the embodiment. It should be noted that all component parts of the preferred embodiment, of the present invention, are made of various gauges of aluminum, and coated with a high "reflectance" white coating. Prior to coating the aluminum substrate, all surfaces of the assembly are "pretreated" to maximize the adhesion of the high reflectance white coating. The cover plate 7, is the only component of the embodiment which is not coated with the high reflectance white coating. To maximize the reflectance of the sun's impingement on this cover plate, it preferably, is a highly polished, light gauge aluminum.

For the purpose of depicting the weight of the preferred embodiment, of the present invention, a prototype having dimensions of approximately two feet in width, and six feet in length, has indicated a total weight of 16 pounds, or approximately 1.33 pounds per square foot.

While the invention has been particularly shown and described in reference to preferred embodiments thereof, it will be understood by those skilled in the art, that changes in form and details may be made without departing from the spirit and scope of the invention.

I claim:

1. An apparatus for regulating the passage of solar light and heat radiation through a window; said apparatus comprising: a center mullion member integrally coupling a plurality of overlapping, interconnected, louver plate members, pivotable about a parallel axes;

said center mullion member having U-shaped cross section;

said center mullion member having a plurality of apertures therethrough, accommodating therein said louver plate members;

the plurality of said louver plate members fixedly mounted to a plurality of louver plate axle members;

a plurality of bearing members fixedly mounted in said apertures of said center mullion member for pivotal mounting therein, the plurality of said louver plate axle members;

a pivot arm member operably coupled to the plurality of said louver plate axle members, for a simultaneous opening closing adjustment of the plurality of said louver plate members;

an adjusting lever member, is fixedly mounted to said louver plate axle member, adjacent to an adjustment opening, in said center mullion member;

a louver plate adjusting hand tool member, for manually adjusting, opening closing, of the plurality of said louver plates;

a cover plate member, fixedly mounted to said center mullion member, to shield the pivoting joints, of said apparatus from direct sun impingement; and a framing means fixedly mounted to the interior peripheral of the window opening, and adjacent to an interior surface of window glazing, for preventing direct solar radiation from entering a peripheral area between said window opening and said apparatus.

2. The apparatus for regulating the passage of solar light and heat radiation through a window, as in claim 1, wherein the elements of said apparatus are selected from a group of aluminum alloys.

3. The apparatus for regulating the passage of solar light and heat radiation through a window, as in claim 1, wherein said louver plate axle member is of a square cross sectional shape.

4. The apparatus for regulating the passage of solar light and heat radiation through a window, as in claim 1, wherein said center mullion member, independently, accommodates all articulate elements of said apparatus.

5. An electronically operated apparatus for regulating the passage of solar light and heat radiation through a window; said apparatus comprising:

a center mullion member for integrally coupling a plurality of overlapping, interconnected, louver plate members, pivotable about a parallel axes;

said center mullion member having a U-shaped cross section;

said center mullion member having a plurality of apertures therethrough accommodating therein said louver plate members;

the plurality of said louver plate members fixedly mounted to a plurality of louver plate axle members;

a plurality of bearing members fixedly mounted in said apertures of said center mullion member for pivotal mounting therein, a plurality of said louver plate axle members;

a pivot arm member operably coupled to the plurality of said louver plate axle members for simultaneous, opening or closing adjustment of the plurality of said louver plate members;

an adjusting lever member, is fixedly mounted to said louver plate axle member, adjacent to adjustment opening in said center mullion member;

an electronic actuator, is operably coupled to said adjusting lever member for automatic, and simultaneous, opening or closing, of the plurality of said louver plate members;

a remote controller, is, thereby the remote means for controlling a selected percentage of, opening or closing, of the plurality of said louver plate members;

a cover plate member fixedly mounted to said center mullion member for shielding the pivoting joints, of said apparatus, from direct sun impingement; and a framing means fixedly mounted to the interior peripheral of the window opening, and adjacent to the interior surface of the window glazing, for preventing direct solar radiation from entering the peripheral area between said window opening and said apparatus.

6. The electronically operated apparatus for regulating the passage of solar light and heat radiation through a window, as in claim 5, wherein the elements of said apparatus, excluding said electronic actuator and said remote controller, are selected from a group of aluminum alloys.

* * * * *